US008947002B2

(12) United States Patent
Le Toquin

(10) Patent No.: US 8,947,002 B2
(45) Date of Patent: Feb. 3, 2015

(54) LED BULB WITH COLOR-SHIFT DIMMING

(71) Applicant: Switch Bulb Company, Inc., San Jose, CA (US)

(72) Inventor: Ronan Le Toquin, Sunnyvale, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 134 days.

(21) Appl. No.: 13/842,733

(22) Filed: Mar. 15, 2013

(65) Prior Publication Data

US 2014/0265923 A1 Sep. 18, 2014

(51) Int. Cl.
*H05B 37/00* (2006.01)
*H05B 33/08* (2006.01)

(52) U.S. Cl.
CPC ..... *H05B 33/086* (2013.01)
USPC ..... 315/185 R; 362/249.06

(58) Field of Classification Search
USPC ..... 315/185 R, 291, 293; 362/249.02, 362/249.06
See application file for complete search history.

(56) References Cited

U.S. PATENT DOCUMENTS

| | | | | |
|---|---|---|---|---|
| 8,791,642 | B2 * | 7/2014 | van de Ven et al. | 315/192 |
| 2013/0077298 | A1 * | 3/2013 | Steele et al. | 362/230 |
| 2014/0043822 | A1 * | 2/2014 | Bhattarai et al. | 362/294 |
| 2014/0159561 | A1 * | 6/2014 | Cumpston et al. | 313/36 |
| 2014/0232288 | A1 * | 8/2014 | Brandes et al. | 315/250 |

* cited by examiner

*Primary Examiner* — Thuy Vinh Tran
(74) *Attorney, Agent, or Firm* — Morrison & Foerster LLP

(57) ABSTRACT

A light-emitting diode (LED) bulb comprises a base and a shell connected to the base. A first set of LEDs is disposed within the shell and is configured to emit light at a first color corresponding to a first black-body color temperature. A second set of LEDs is also disposed within the shell and is configured to emit light at a second color corresponding to a second black-body color temperature that is different from the first black-body color temperature. A control circuit is configured to provide a transitional-power state to the first and second sets of LEDs to transition between an initial-power state and a reduced-power state by producing a shifting color output that corresponds to a predetermined light-output curve.

18 Claims, 10 Drawing Sheets

700

| | COLOR TEMP | LUMINOUS FLUX | Ccx | Ccy | SET 1 (431) | SET 2 (432) | SET 3 (433) | SET 4 (434) | SET 5 (435) |
|---|---|---|---|---|---|---|---|---|---|
| 1 | 2,700 K | 100% | 0.459 | 0.410 | 1.5 | 1.4 | 0.5 | 0.8 | 1.5 |
| 2 | 2,584 K | 84% | 0.469 | 0.412 | 0.5 | 1.4 | 1.0 | 0.7 | 1.2 |
| 3 | 2,494 K | 75% | 0.477 | 0.413 | 0 | 1.4 | 1.4 | 0.7 | 0.8 |
| 4 | 2,380 K | 32% | 0.487 | 0.413 | 0 | 0.5 | 1.0 | 0.3 | 0 |
| 5 | 2,290 K | 23% | 0.495 | 0.413 | 0 | 0.2 | 1.0 | 0.1 | 0 |
| 6 | 2,200 K | 18% | 0.503 | 0.412 | 0 | 0 | 1.0 | 0 | 0 |

FIG. 7

LED BULB WITH COLOR-SHIFT DIMMING

BACKGROUND

1. Field

The present disclosure relates generally to light-emitting diode (LED) bulbs and, more specifically, to an LED bulb that produces shifting color output as the luminous flux of the LED bulb is reduced.

2. Description of Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

Traditional incandescent bulbs are capable of producing variable levels of light output by, for example, reducing the electrical power applied to the filament element. Typically, as an incandescent bulb is dimmed, it produces a warmer or red-shifted light color. Because we are accustomed to incandescent bulbs, when the light output of a bulb is reduced we commonly expect the light color to also be red-shifted to produce a dimmed, warm light output. In some lighting scenarios, such as indoor residential lighting, the red-shifted color may even be a desirable result.

The red-shifting of an incandescent bulb is due, at least in part, to the properties of the filament used to produce the light. Typically, as the light output of an incandescent bulb is reduced (the bulb is dimmed), the filament cools and the black-body color temperature of the emitted light is also reduced. The black-body color temperature (CCT) represents the color of light emitted from an ideal (Planckian) black-body at the specified absolute temperature. A reduction in the black-body color temperature is typically perceived as a red-shift in the color of the emitted light which may be perceived as a "warmer" light (even though the black-body color temperature is actually reduced).

In some applications, LED bulbs may also be dimmed to produce reduced levels of light output. However, in contrast to a traditional incandescent bulb, as the light output of an LED is reduced, the color of the light emitted by the LED remains relatively constant. As a result, the light produced by a traditional LED bulb remains at the same black-body color temperature as the LED bulb is dimmed.

In some cases, it may be desirable to provide an LED bulb that produces a variable light output that approximates the variable light output of a traditional incandescent light bulb. The techniques described herein may be used to achieve a color shift as the light output of the LED bulb is changed.

BRIEF SUMMARY

In one exemplary embodiment, a light-emitting diode (LED) bulb comprises a base and a shell connected to the base. A first set of LEDs is disposed within the shell and is configured to emit light at a first color. A second set of LEDs is also disposed within the shell and is configured to emit light at a second color that is different from the color emitted from the first set of LEDs. A control circuit is configured to provide an initial-power state, a reduced power state, and a transitional power state. Specifically, the control circuit provides the first power state to the first and second sets of LEDs to produce a first bulb light output having a first predicted luminous flux and a first predicted color. The control circuit also provides a reduced-power state to the first and second sets of LEDs to produce a second bulb light output having a second predicted luminous flux and a second predicted color. The control circuit also provides a transitional-power state to the first and second sets of LEDs to transition between the initial-power state and the reduced-power state, wherein the transitional-power state is configured to produce a shifting color output that corresponds to a predetermined light-output curve having a first point corresponding to the first predicted color and a second point corresponding to the second predicted color.

In some embodiments, the transitional-power state is configured to produce a shifting color output that corresponds to a predicted color output of an ideal Planckian black body emitter.

In some embodiments, the first predicted luminous flux is greater than the second luminous flux, and the first predicted color corresponds to a first predicted black-body color temperature that is greater than a second predicted black-body color temperature corresponding to the second predicted color.

In some embodiments, the control circuit is configured to provide a first power output to the first set of LEDs and a second power output to the second set of LEDs. The second power output is independently adjustable with respect to the first power output to produce the shifting color output that corresponds to the predetermined light-output curve.

DESCRIPTION OF THE FIGURES

FIG. 7 depicts a table of power states for a liquid-filled LED bulb.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below, relating to LED bulbs. As used herein, an "LED bulb" refers to any light-generating device (e.g., a lamp) in which at least one LED is used to generate light. Thus, as used herein, an "LED bulb" does not include a light-generating device in which a filament is used to generate the light, such as a conventional incandescent light bulb. It should be recognized that the LED bulb may have various shapes in addition to the bulb-like A-type shape of a conventional incandescent light bulb. For example, the bulb may have a tubular shape, a globe shape, or the like. The LED bulb of the present disclosure may further include any type of connector; for example, a screw-in base, a dual-prong connector, a standard two- or three-prong wall outlet plug, bayonet base, Edison Screw base, single-pin base, multiple-pin base, recessed base, flanged base, grooved base, side base, or the like.

The LED bulb embodiments described herein are configured to produce a color shift as the light output of the LED bulb is changed. In particular, the color output of the LED bulb reduces in black-body color temperature as the LED bulb is dimmed. In some embodiments, the color shift of the LED bulb corresponds to the color shift observed in a traditional incandescent bulb that is dimmed. In this way, an LED bulb can be made to mimic the light output of a dimmable incandescent bulb.

Figure 1A:
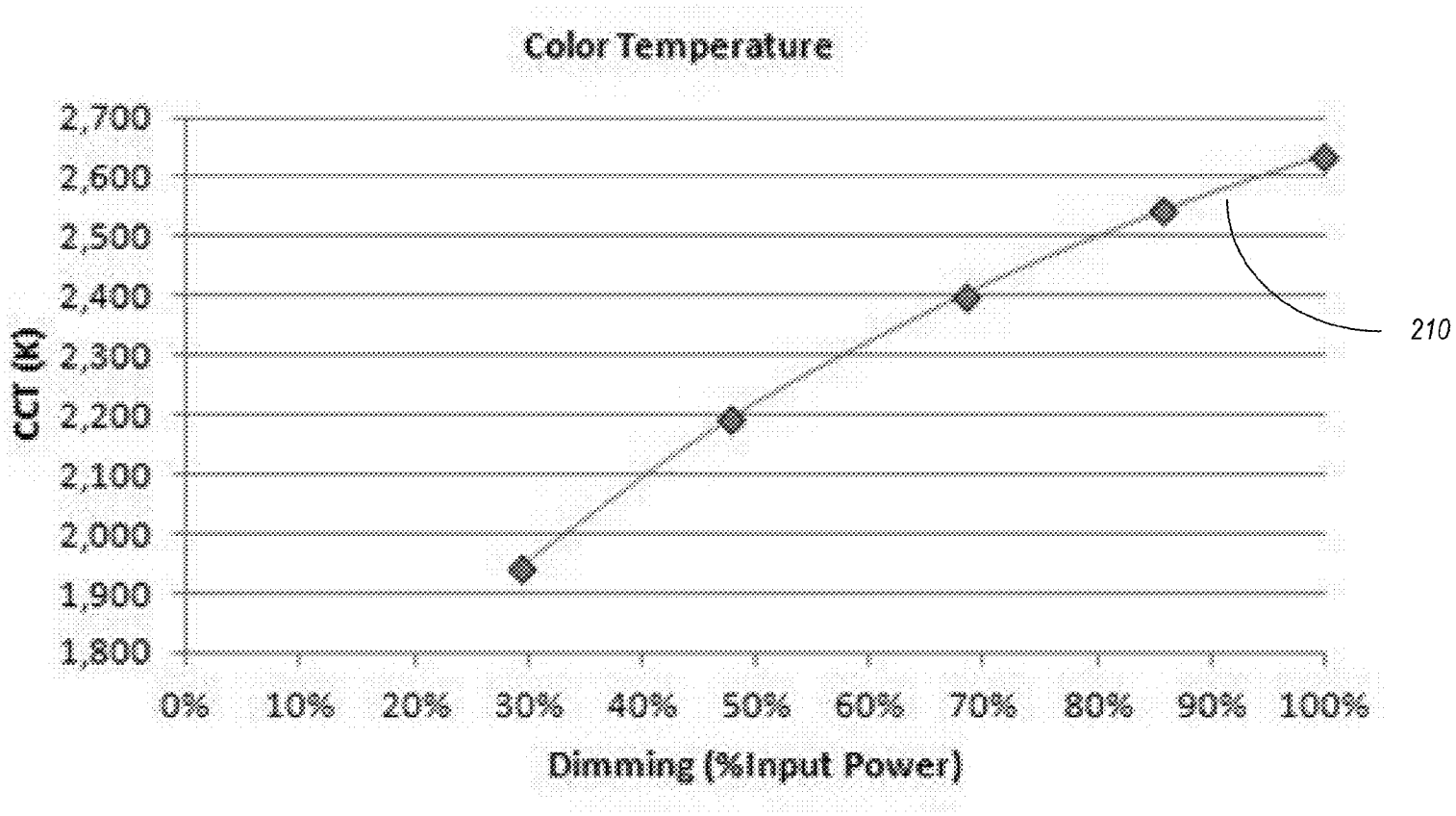
FIGS. 1A and 1B depict predicted light color and luminous flux as a function of input power for an incandescent bulb.
Figure 1B:
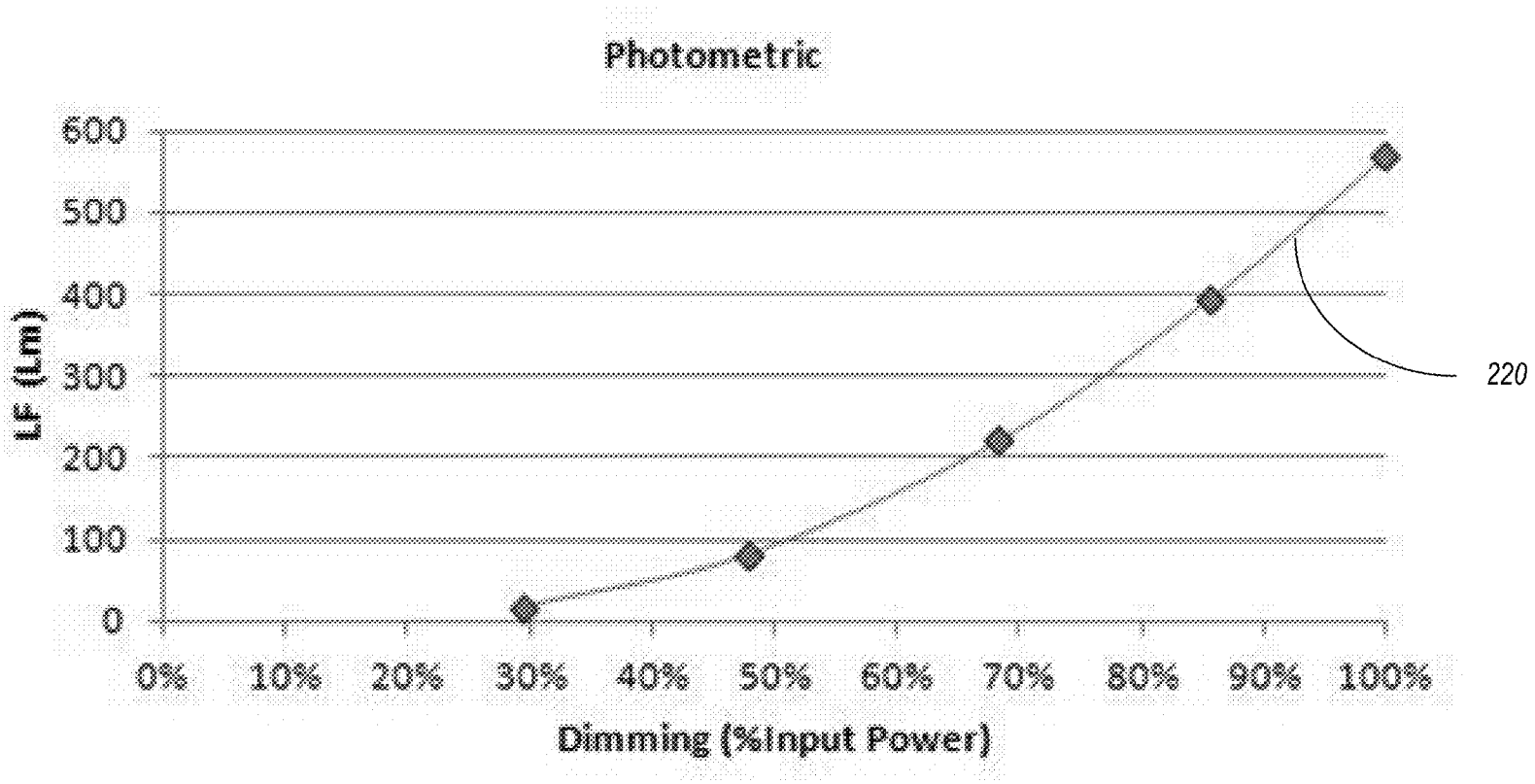

FIGS. 1A and 1B depict the predicted light color and luminous flux as a function of input power for an incandescent bulb. The light output depicted in FIGS. 1A and 1B also represent an exemplary predicted light output for an LED bulb configured to shift color as it is dimmed. For purposes of this discussion, the predicted light-output curves shown in FIGS. 1A and 1B may also approximate the predicted light output of an ideal Planckian black-body emitter.

FIG. 1A depicts an exemplary light-output curve 210 representing the predicted color output as a function of the percentage of input power relative to a full-power state (100 percent). As shown in FIG. 1A, the black-body color temperature changes from approximately 2600 degrees Kelvin at a first point for 100-percent bulb power to approximately 1,900 degrees Kelvin at a second point for 30-percent bulb power. Between the 100-percent bulb power (full-power state or initial-power state) and 30-percent bulb power (reduced-power state) the predicted color output of the bulb transitions between the full- or initial-power state and the reduced-power state according to the predicted light-output curve 210. As described in more detail below, an LED bulb having at least two sets of LEDs of different colors can be configured to produce a shifting color output that corresponds to the predicted light-output curve 210.

In this example, the first point corresponding to the first predicted color of 2,700 degrees Kelvin at an initial-power state, and the second point corresponds to the second predicted color of 1,900 degrees Kelvin at a reduced-power state. However, it is not necessary that the first and second points correspond to the end points of the predicted light-output curve 210. For example, either the first point of an initial-power state or the second point of a reduced-power state may correspond to an intermediate point or location on the predicted light-output curve 210.

FIG. 1B depicts an exemplary light output curve 220 representing the predicted luminous flux, measured in Lumens (Lm), as a function of the percentage of input power relative to a full-power state (100 percent). As shown in FIG. 1B, the luminous flux of the bulb changes from approximately 600 Lm at a first point for 100-percent bulb power to approximately 0 Lm at a second point for 30-percent bulb power. Between the 100-percent bulb power (full- or initial-power state) and 30-percent bulb power (reduced-power state) the predicted luminous flux of the bulb transitions between the full- or initial-power state and the reduced-power state according to the predicted light output curve 220.

As previously mentioned, the light-output curves 210, 220 depicted in FIGS. 1A and 1B also represent an exemplary predicted light output for an LED bulb configured to shift color as it is dimmed. The points along the light-output curves 210, 220 may represent various power states of an exemplary LED bulb. The light output curves 210, 220 represent a predicted light output for transitions between the power states. Light-output curves 210, 220 provide a smooth transition between the power states. In general, it is desirable to provide a transition between two or more power states of an LED bulb without an abrupt change in either color or luminous flux of the light output.

For an LED bulb configured to shift color as it is dimmed, the exemplary light-output curves 210, 220 of FIGS. 1A and 1B also represent a predetermined transition between the power states. For example, the light-output curves may be based on a table of multiple power states providing various power levels to two or more sets of LEDs of different colors. Furthermore, an interpolation algorithm, such as a linear or polynomial interpolation algorithm, may be used to generate and store transitions between two or more power states. Alternatively, the transition between power states may be generated at nearly the same time as the power to the LED bulb is adjusted. In other embodiments, the transition between power states may be implemented using analog electronic circuitry that is configurable to provide a transition between power states that corresponds to a predetermined light-output curve.

1. Exemplary LED Bulb

Figure 2:
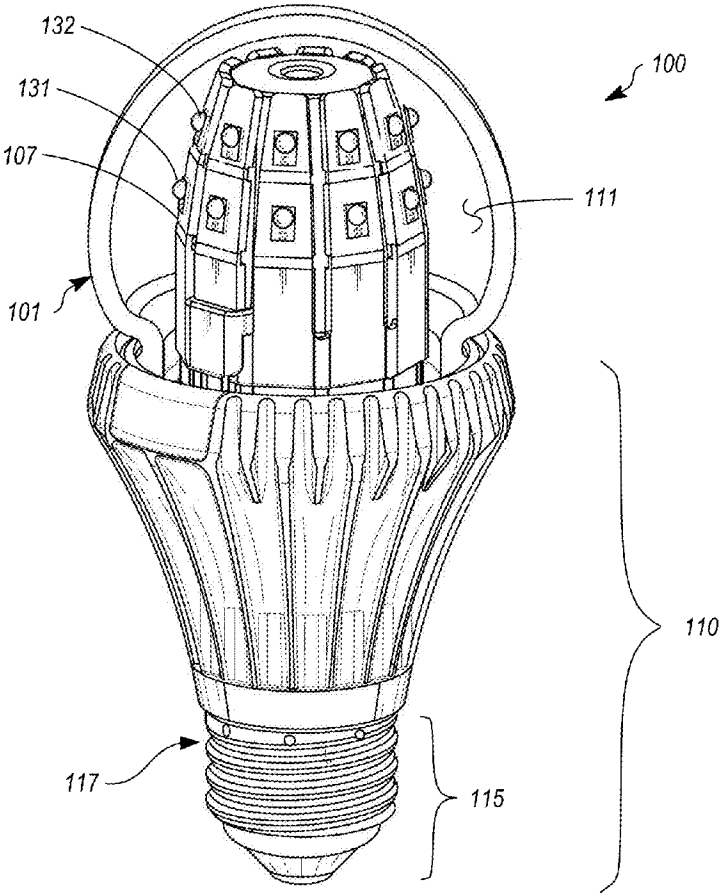
FIG. 2 depicts an LED bulb.

FIG. 2 depicts an exemplary liquid-filled LED bulb 100. LED bulb 100 includes a base 110 and a shell 101 encasing the various components of LED bulb 100. The shell 101 is attached to the base 110 forming an enclosed volume. Two rows of LEDs 131, 132 are mounted to support structure 107 and are disposed within the enclosed volume. The enclosed volume is filled with a thermally conductive liquid 111.

For convenience, all examples provided in the present disclosure describe and show LED bulb 100 being a standard A-type form factor bulb. However, as mentioned above, it should be appreciated that the present disclosure may be applied to LED bulbs having any shape, such as a tubular bulb, globe-shaped bulb, or the like.

Shell 101 may be made from any transparent or translucent material such as plastic, glass, polycarbonate, or the like. The shell 101 may be transparent or substantially clear. The shell 101 may also be treated to diffuse the light emitted from the LEDs 131, 132. For example, the shell 101 may be frosted to disperse light produced by the LEDs 131, 132.

As noted above, light bulbs typically conform to a standard form factor, which allows bulb interchangeability between different lighting fixtures and appliances. Accordingly, in the present exemplary embodiment, LED bulb 100 includes connector base 115 for connecting the bulb to a lighting fixture. In one example, connector base 115 may be a conventional light bulb base having threads 117 for insertion into a conventional light socket. However, as noted above, it should be appreciated that connector base 115 may be any type of connector for mounting LED bulb 100 or coupling to a power source. For example, connector base may provide mounting via a screw-in base, a dual-prong connector, a standard two- or three-prong wall outlet plug, bayonet base, Edison Screw base, single-pin base, multiple-pin base, recessed base, flanged base, grooved base, side base, or the like.

In some embodiments, LED bulb 100 may use 6 W or more of electrical power to produce light equivalent to a 40 W incandescent bulb. In some embodiments, LED bulb 100 may use 18 W or more to produce light equivalent to or greater than a 75 W incandescent bulb. Depending on the efficiency of the LED bulb 100, between 4 W and 16 W of heat energy may be produced when the LED bulb 100 is illuminated.

The LED bulb 100 includes several components for dissipating the heat generated by LEDs 131, 132. For example, as shown in FIG. 2, LED bulb 100 includes one or more support structures 107 for mounting LEDs 131, 132. The one or more support structures 107 may be made of any thermally conductive material, such as aluminum, copper, brass, magnesium, zinc, or the like. In some embodiments, the support structures are made of a composite laminate material. Since support structures 107 are formed of a thermally conductive material, heat generated by LEDs 131, 132 may be conductively transferred to support structures 107 and passed to other components of the LED bulb 100 and the surrounding environment. Thus, support structures 107 may act as a heat-sink or heat-spreader for LEDs 131, 132.

Support structures 107 are attached to bulb base 110, allowing the heat generated by LEDs 131, 132 to be conducted to other portions of LED bulb 100. Support structures 107 and bulb base 110 may be formed as one piece or multiple pieces. The bulb base 110 may also be made of a thermally conductive material and attached to support structures 107 so that heat generated by LED 131, 132 is conducted into the bulb base 110 in an efficient manner. Bulb base 110 is also attached to shell 101. Bulb base 110 can also thermally conduct with shell 101.

Bulb base 110 also includes one or more components that provide the structural features for mounting bulb shell 101 and support structure 107. Components of the bulb base 110 include, for example, sealing gaskets, flanges, rings, adaptors, or the like. Bulb base 110 also includes a connector base 115 for connecting the bulb to a power source or lighting fixture. Bulb base 110 can also include one or more die-cast parts.

LED bulb 100 of the present embodiment is filled with thermally conductive liquid 111 for transferring heat generated by LEDs 131, 132 to shell 101. The thermally conductive liquid 111 fills the enclosed volume defined between shell 101 and bulb base 110, allowing the thermally conductive liquid 111 to thermally conduct with both the shell 101 and the bulb base 110. In some embodiments, thermally conductive liquid 111 is in direct contact with LEDs 131, 132.

In an alternative embodiment, the LED bulb does not include a thermally conductive liquid. In this alternative embodiment, the LEDs emit light directly into a gas medium and conduct heat primarily through the mounting surface of the LEDs to other elements of the LED bulb, such as a support structure and base.

Figure 3A:
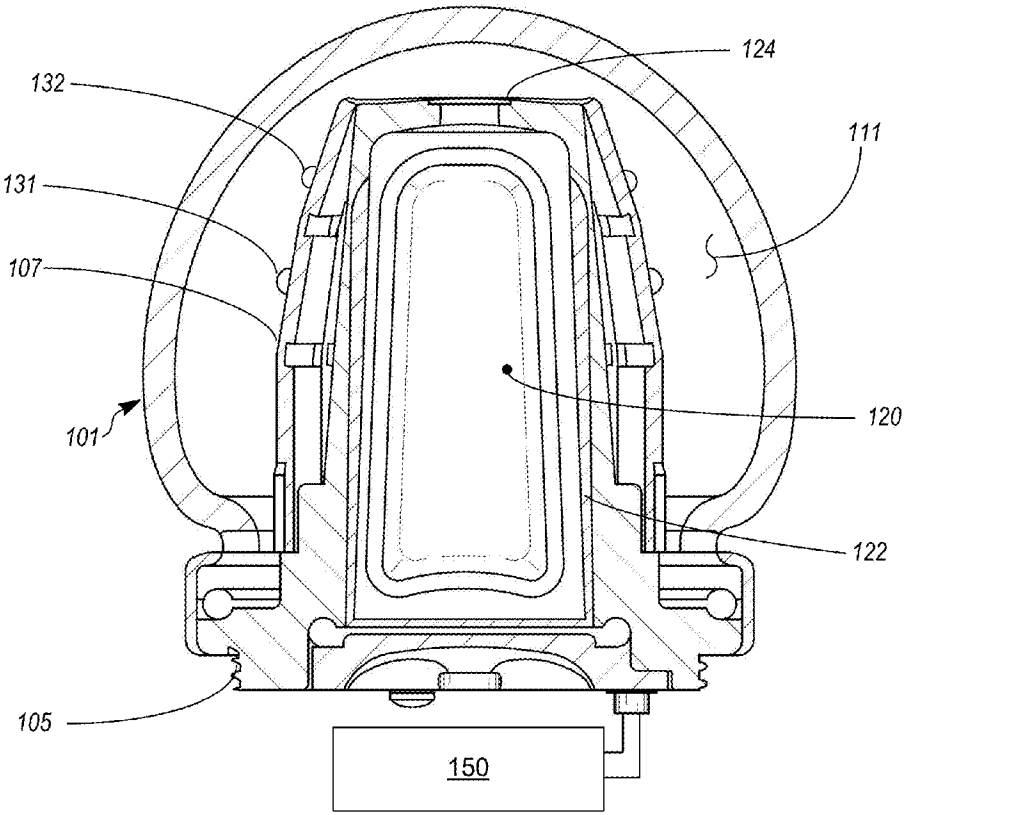
FIGS. 3A and 3B depict a cross-sectional view of an LED bulb.
Figure 3B:
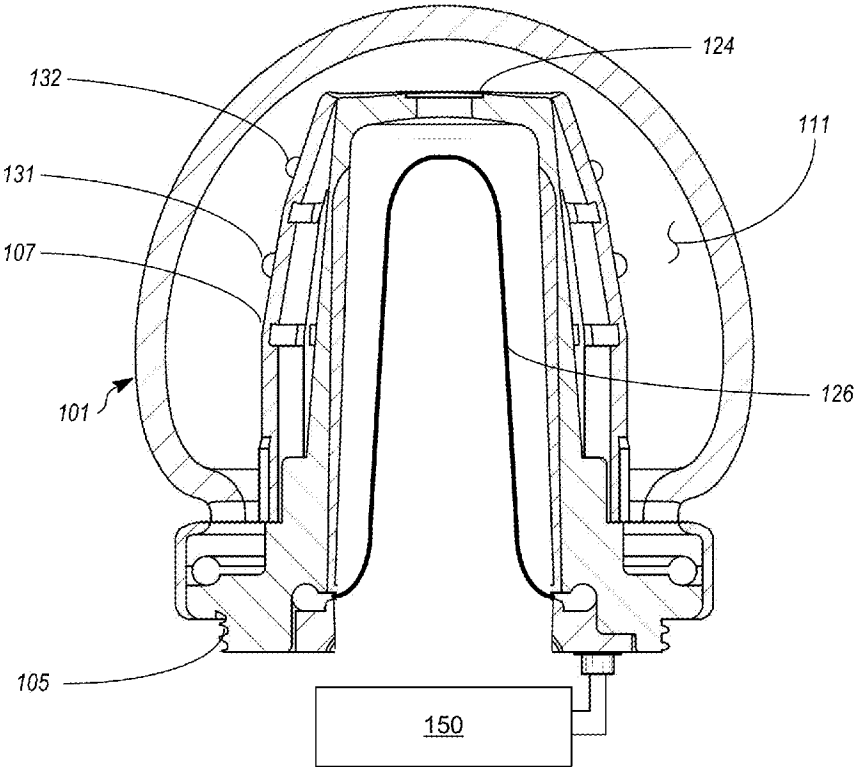

In the LED bulb embodiment depicted in FIGS. 2, 3A-B, thermally conductive liquid 111 may be any thermally conductive liquid, mineral oil, silicone oil, glycols (PAGs), fluorocarbons, or other material capable of flowing. It may be desirable to have the liquid chosen be a non-corrosive dielectric. Selecting such a liquid can reduce the likelihood that the liquid will cause electrical shorts and reduce damage done to the components of LED bulb 100.

As used herein, the term "liquid" refers to a substance capable of flowing. Also, the substance used as the thermally conductive liquid is a liquid or at the liquid state within, at least, the operating temperature range of the bulb. An exemplary temperature range includes temperatures between −40° C. and +50° C. Also, as used herein, "passive convective flow" refers to the circulation of a liquid without the aid of a fan or other mechanical devices driving the flow of the thermally conductive liquid.

LED bulb 100 also includes a mechanism to allow for thermal expansion of thermally conductive liquid 111 contained in the LED bulb 100. In the present exemplary embodiment, the mechanism is a bladder 120. In FIG. 3A, the bladder 120 is disposed in a cavity 122 of the bulb base 110. The cavity 122 is in fluidic connection with the enclosed volume created between the shell 101 and base 110. As shown in FIG. 3A, a channel 124 connects the enclosed volume and the cavity 122, allowing the thermally conductive liquid 111 to enter the cavity 122. The outside surface of the bladder 120 is in contact with the thermally conductive liquid 111. The volume of the cavity that is not occupied by the bladder 120 is typically filled with the thermally conductive liquid 111. The bladder 120 is capable of compression and/or expansion to compensate for expansion of the thermally conductive liquid 111.

FIG. 3B depicts an alternative configuration using a diaphragm 126 to compensate for thermal expansion of the thermally conductive liquid. In this embodiment, one surface of the diaphragm 126 is in fluidic connection with the thermally conductive liquid. The opposite surface is typically exposed to ambient pressure conditions (e.g., vented to the ambient air outside the bulb). The diaphragm 126 is capable of deformation and/or movement to compensate for expansion of the thermally conductive liquid 111.

As shown in FIGS. 2, 3A, and 3B, the LED bulb 100 includes a first set of LEDs 131 and a second set of LEDs 132 attached to support structure 107. The support structure 107 is attached to the base 110 using intermediate hub element 105.

The first set of LEDs 131 is configured to emit light at a first color and the second set of LEDs 132 is configured to emit light at a second color, which is different from the first color. In some cases, the first color is associated with a first black-body color temperature and the second color is associated with a second black-body color temperature. The first and second black-body color temperatures are typically determined by the type of semiconductor material used to make the LEDs (e.g., gallium nitride (GaN)) and one or more photoluminescent materials (e.g., phosphors) coating the light-emitting surface of the LEDs.

As described in more detail below with respect to FIG. 4, the relative power provided to the two sets of LEDs can be adjusted to produce a light output for the LED bulb 100 having a variable third color, which is a combination of the first and second colors of the first and second sets of LEDs. Additionally, the combined power provided to the two sets of LED can also be adjusted to provide various levels of luminous flux. By adjusting both the combined power and the relative power provided to the first and second sets of LEDs, the LED bulb 100 can be both dimmed and color-shifted to produce a lighting effect that corresponds to a dimming incandescent bulb.

As shown in FIG. 2, the LEDs 131, 132 are mounted in relative proximity to each other on a single support structure 107. Also, in the present embodiment, the number of LEDs in the first set 131 is equal to the number of LEDs in the second set 132. This configuration may be advantageous for producing an LED bulb 100 having a light output that is substantially uniform. However, this particular configuration is not necessary to produce a substantially uniform light output. In alternative embodiments, the sets of LEDs may not be of equal numbers and may not be mounted in relative proximity to each other within the shell of the LED bulb.

The first and second set of LEDs 131, 132 are electrically connected to a control circuit 150 located within the base 110 of the LED bulb 100. FIGS. 3A and 3B depict cross-sectional views of the LED bulb 100 and the approximate location of the control circuit 150. The control circuit may include one or more printed circuit boards or other electrical component assemblies disposed within the base 110 of the LED bulb 100. In the present embodiment, the control electronics are contained entirely within the base 110. However, in alternative embodiments, all or portions of the control circuit 150 may be located external to the base 110 and/or the LED bulb 100.

Figure 4:
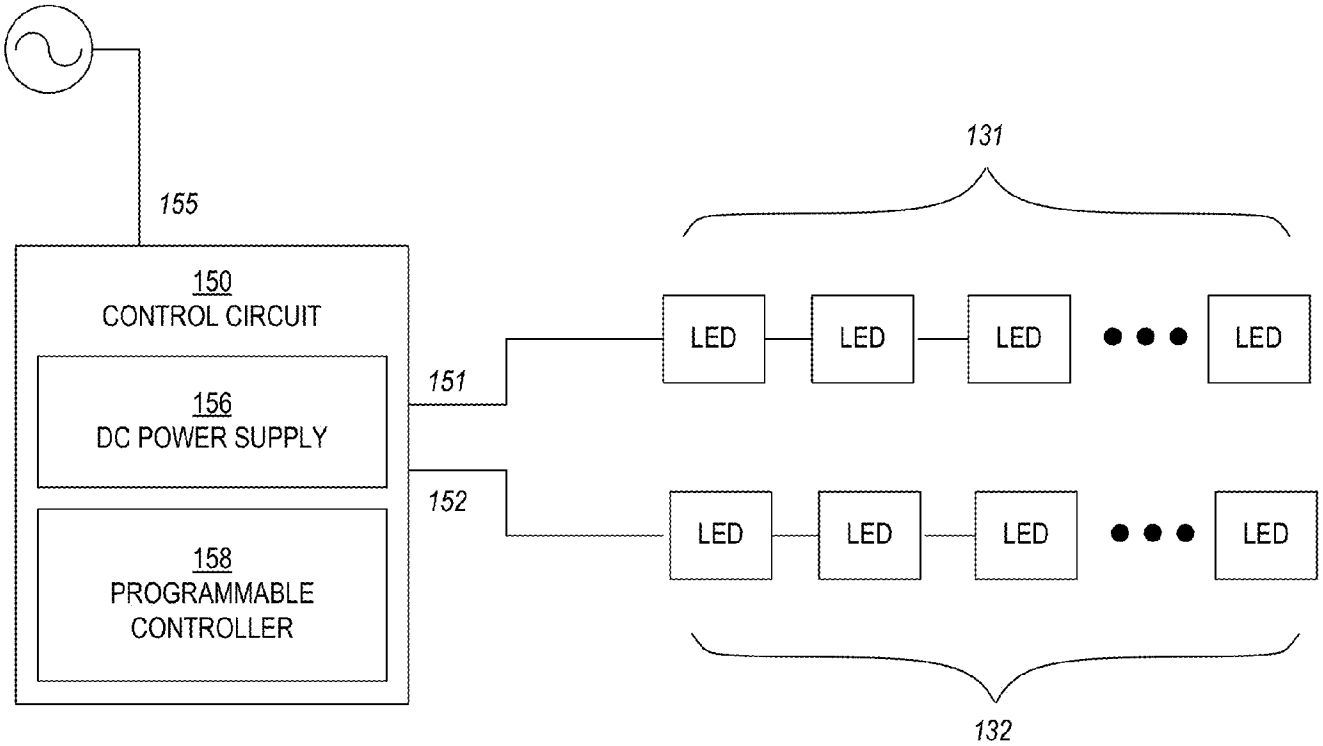
FIG. 4 depicts a schematic diagram of a control circuit and two sets of LEDs.

FIG. 4 depicts a schematic diagram of the control circuit 150 and the first and second set of LEDs 131, 132. As shown in FIG. 4, the first set of LEDs 131 is electrically connected in series to a first power output 151 of the control circuit 150 and the second set of LEDs 132 is electrically connected in series to a second power output 152 of the control circuit 150. First and second power outputs 151, 152 may be connected to the LEDs using electrical wires, conductive strips, printed traces, electrical vias, or the like.

In the present embodiment, the control circuit 150 includes a power input 155 configured to receive AC power from a traditional lighting fixture via the connector base 117 of the LED bulb 100. The control circuit 150 also includes a DC-power supply 156 that converts the AC power provided to the power input 155 into DC power for the first and second power outputs 151, 152. As discussed below with respect to FIG. 5, additional power outputs may be present in LED bulbs having more than two sets of LEDs.

The control circuit 150 also includes one or more configurable components for setting the first and second power outputs 151, 152 in response to the power input 155. In the present embodiment, the control circuit 150 includes a programmable controller 158 having an integrated circuit that can be configured to control the first and second power outputs 151, 152. The programmable controller 158 includes non-transitory memory for storing control parameters and may be flash-programmed during manufacturing. In an alternative embodiment, the control circuit 150 does not include a programmable controller 158 and the power outputs 151, 152 are set using non-programmable electrical components.

The control circuit 150 is configured to provide first and second power outputs 151, 152 that are capable of producing variable levels of power to the LEDs. In general, the first and second power outputs 151, 152 may be adjusted in concert or independently from each other. For example, the first and second power outputs 151, 152 can be reduced in concert to provide a reduced light output from the first and second set of LEDs 131, 132. The first power output 151 may also be reduced independently of the second power output 152 to produce a color shift in the light emitted by the LED bulb 100.

In the present embodiment, the control circuit 150 provides variable levels of power to the first and second sets of LEDs, which are configured to emit light at different colors. In one example, the first set of LEDs 131 is configured to emit light at a first color that corresponds to a black-body color temperature of approximately 3,000 degrees Kelvin. The second set of LEDs 132 is configured to emit light at a second color that corresponds to a black-body temperature of approximately 2,200 degrees Kelvin. The control circuit 150 is configured to control the color output of the LED bulb 100 by independently adjusting the power provided to the two sets of LEDs relative to each other.

In this example, the color output of the LED bulb 100 may correspond to a black-body color temperature ranging between 2,200 and 3,000 degrees Kelvin, depending on ratio of power provided to the first set of LEDs 131 with respect to the second set of LEDs 132. Providing increased power to the second set of LEDs 132 relative to the first set of LEDs 131 will result in the light output of the LED bulb 100 having a color shift toward a black-body color temperature of 2,200 degrees Kelvin. Similarly, providing increased power to the first set of LEDs 131 relative to the second set of LEDs 132 will result in the light output of the LED bulb 100 having a color shift toward a black-body color temperature of 3,000 degrees Kelvin.

As mentioned above, control circuit 150 is also configured to adjust the power to the first and second sets of LEDs in concert. In one example, both the first power output 151 to the first set of LEDs 131 and the second power output 152 to the second set of LEDs 132 can be reduced by 50%. By reducing the power to both sets of LEDS by the same proportion, the luminous flux of the LED bulb can be reduced without changing the overall color of the light emitted by the LED bulb.

In a typical implementation, the control circuit 150 is configured to adjust the power outputs 151, 152 to the first and second sets of LEDs 131, 132 both in concert and independent from each other to produce a variable light output and variable light color. For example, the overall light output (luminous flux) of the LED bulb can be reduced by reducing the power outputs 151, 152 provided to both the first and second sets of LEDs 131, 132, in concert. In one case, the first output 151 and the second output 152 can be reduced by the same proportion (e.g., 25%) resulting in an approximate 25% reduction in luminous flux. The color of the light can also be controlled by adjusting the power outputs 151, 152 provided to the first and second sets of LEDs independent from each other. In one case, the first power output 151 to the first set of LEDs 131 is reduced by 50% with respect to the second power output 152 provided to the second set of LEDs 132 resulting in a color shift in the overall light emitted by the LED bulb 100. Thus, by adjusting the LEDs in concert and independent from each other, both the luminous flux and light color can be controlled.

In a typical implementation, the control circuit 150 is configured to change both the color of the emitted light and luminous flux in response to a change in the electrical power supplied to the power input 155. In general, a reduction in the electrical power provided to power input 155 will result in a reduction in both the black-body color temperature of the light and the luminous flux of the LED bulb. FIGS. 1A and 1B, discussed above, depict an exemplary relationship between the electrical power provided to the LED bulb (via for example power input 155) and the predicted color output and predicted luminous flux of the LED bulb. As discussed with respect to FIGS. 1A and 1B above, the LED bulb 100 is configured to produce a light output and light color corresponding to one or more light-output curves to simulate the light output of a traditional incandescent bulb.

The variable output of the LED bulb may be described with respect to two or more power states and one or more transitional-power states between the two or more power states. For example, the control circuit 150 may be configured to provide two or more power states for the LED bulb 100, each power state providing a specified power level to the first and second set of LEDs 131, 132. Typically, the two or more power states correspond to two or more light outputs having different levels of luminous flux and different colors of the light. In some cases, the two or more power states correspond to the predicted light output associated with an incandescent bulb as it is dimmed. The control circuit 150 is also configured to provide one or more transitional-power states to produce a transition between two of the two or more power states.

In one example, the control circuit 150 provides an initial-power state to the first and second set of LEDs 131, 132. The initial-power state is associated with an initial first power level provided to the first set of LEDs 131 via the first power output 151. Similarly, the initial-power state is also associated with an initial second power level provided to the second set of LEDs 132 via the second power output 152. The initial-power state is configured to produce a light output having a first predicted luminous flux and a first predicted color that is the combination of the colors emitted by the first and second sets of LEDs 131, 132. The initial-power state may be associated with a full-power state. However a full-power state is not necessarily representative of the maximum power that can be provided to the first and second set of LEDs 131, 132.

In this example, the control circuit 150 also provides a reduced-power state configured to produce a light output having a second, reduced predicted luminous flux and a second predicted color that is associated with a black-body color temperature that is less than a black-body color temperature associated with the first predicted color.

Figure 8:
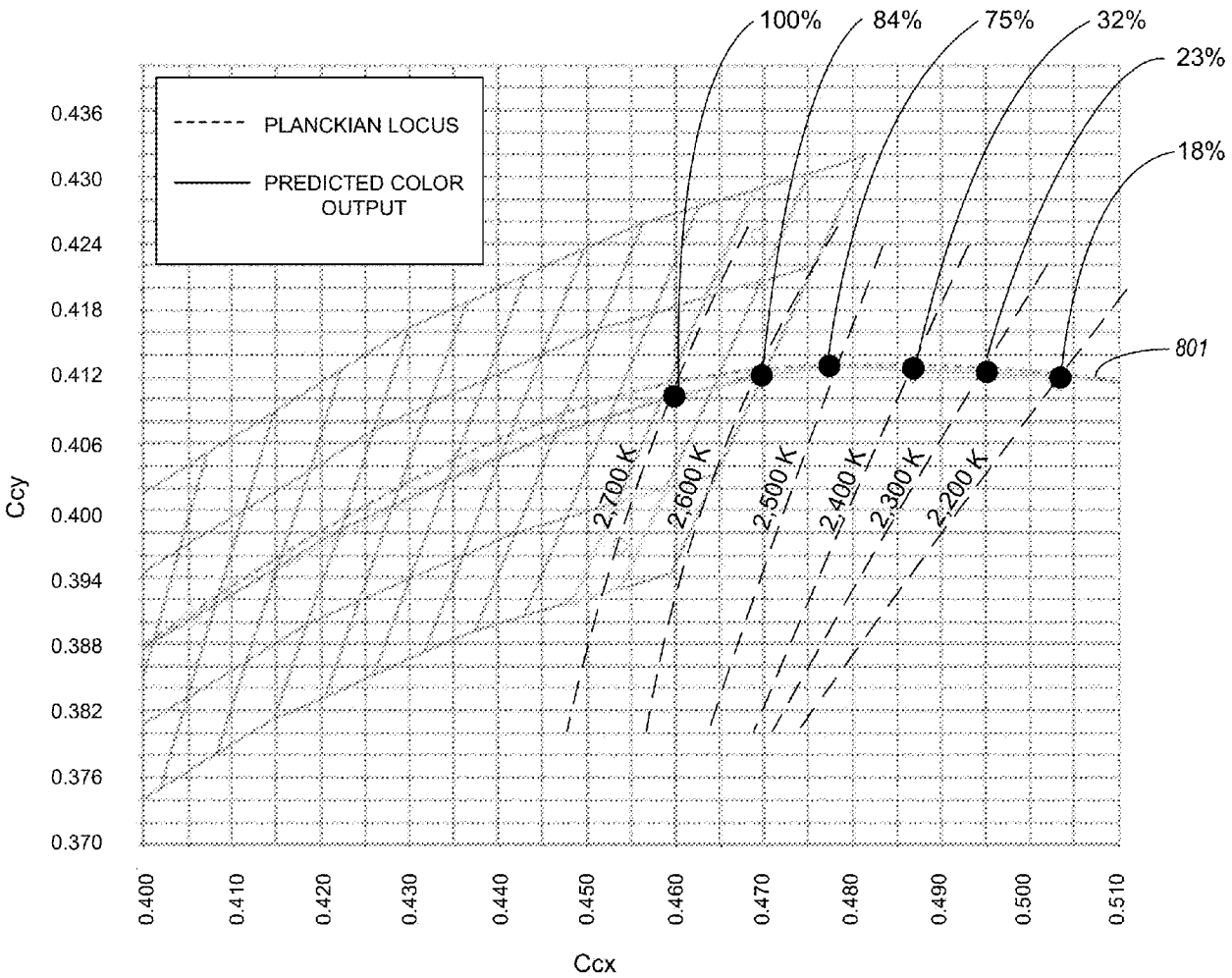
FIG. 8 depicts a chart of predicted color values associated with various power states of a liquid-filled LED bulb.

The control circuit 150 is configured to switch between the initial-power state and reduced-power state in response to a change in the power provided to the LED bulb. The control circuit 150 is further configured to provide a transitional-power state to provide a transition between the initial and reduced power states as the power provided to the LED bulb is changed. In some cases, the transitional-power state is configured to produce an LED light output that corresponds to a predicted light-output curve. Exemplary light-output curves 210, 220 expressed in terms of bulb power are depicted in FIGS. 1A and 1B. Another exemplary light-output curve 801 in Ccx-Ccy space is depicted in FIG. 8, and discussed below.

The LED bulb 100 provided in this example includes two sets of LEDs 131, 132. However, as discussed further in the example depicted in FIG. 5, it may be advantageous to provide an LED bulb including a control circuit having more than two power outputs to control more than two sets of LEDs, each additional set of LEDs configured to emit light at a different color.

2. Color Shifting Using Multiple Sets of LEDs in an LED Bulb

In the example below, multiple rows of LEDs are used to produce an LED bulb configured to shift the color of emitted light as the bulb is dimmed. Specifically, a liquid-filled LED bulb having five sets of LEDs, each set producing light at a different color, is configured to produce a dimmable light output that shifts color similar to a traditional incandescent bulb.

Figure 5:
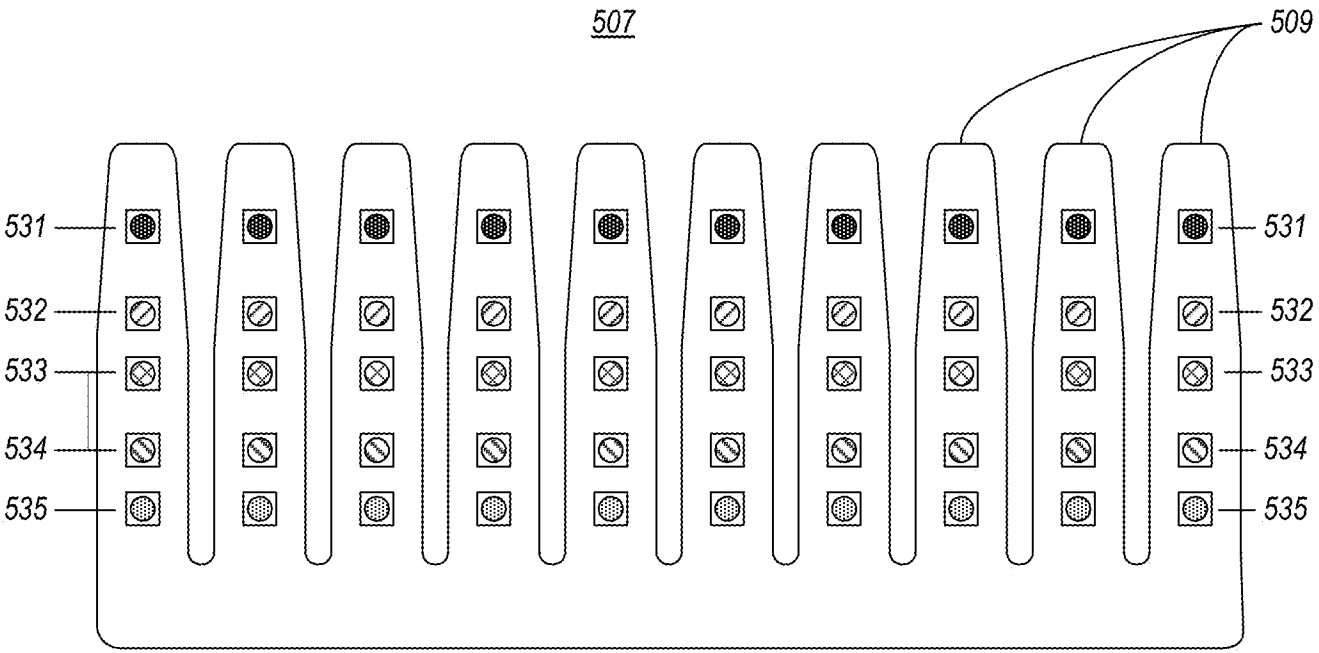
FIG. 5 depicts an exemplary support structure and multiple rows of LEDs.

FIG. 5 depicts an exemplary support structure and multiple rows of LEDs before the support structure has been formed into a cylindrical shape and installed in a liquid-filled LED bulb. As shown in FIG. 5, the support structure 507 includes multiple flange portions 509, each flange portion mounting five LEDs, one from each set of LEDs. In the present embodiment, the support structure is made from a laminate sheet material that includes electrical traces for routing power to the LEDs and a thermally conductive substrate (aluminum) for spreading heat produced by the LEDs. The flange portions 509 facilitate heat transfer from the LEDs to the thermally conductive liquid.

In a typical implementation, the LEDs are attached to the support structure 507 while the support structure 507 is flat. The support structure 507 is then formed into a cylindrical or conical shape and attached to the base of an LED bulb. A similar configuration is depicted in FIGS. 2, 3A, and 3B depicting support structure 107 attached to base 110 via an intermediate hub element 105.

In the present embodiment, each set of LEDs is located in a different row, as indicated in FIG. 5. The first set of LEDs 531 is located near the tip of the flange portions 509, one LED from the first set attached to each flange portion 509 of the support structure 507. The second set of LEDs 532 is positioned adjacent to the first set of LEDs 531, one LED from the second set attached to each flange portion 509. The third, fourth, and fifth sets of LEDs (533, 534, 535) are arranged in rows in a similar fashion.

Each set of LEDs is made from an LED configured to emit light at a different color. Typically, the LEDs are formed from a GaN semiconductor material and coated with one or more phosphor materials. As previously mentioned, the composition of the phosphor coating determines, in part, the color of the light emitted from the LED. The predicted color output of each LED may be described with respect to a black-body color temperature and/or a bin code. As explained previously, a black-body color temperature value corresponds to the color of light emitted from an ideal (Planckian) black-body emitter at the specified absolute temperature. A bin code is an LED specification that typically corresponds to a range of color values that are considered within the manufacturing tolerance for the specified bin code.

Figure 6:
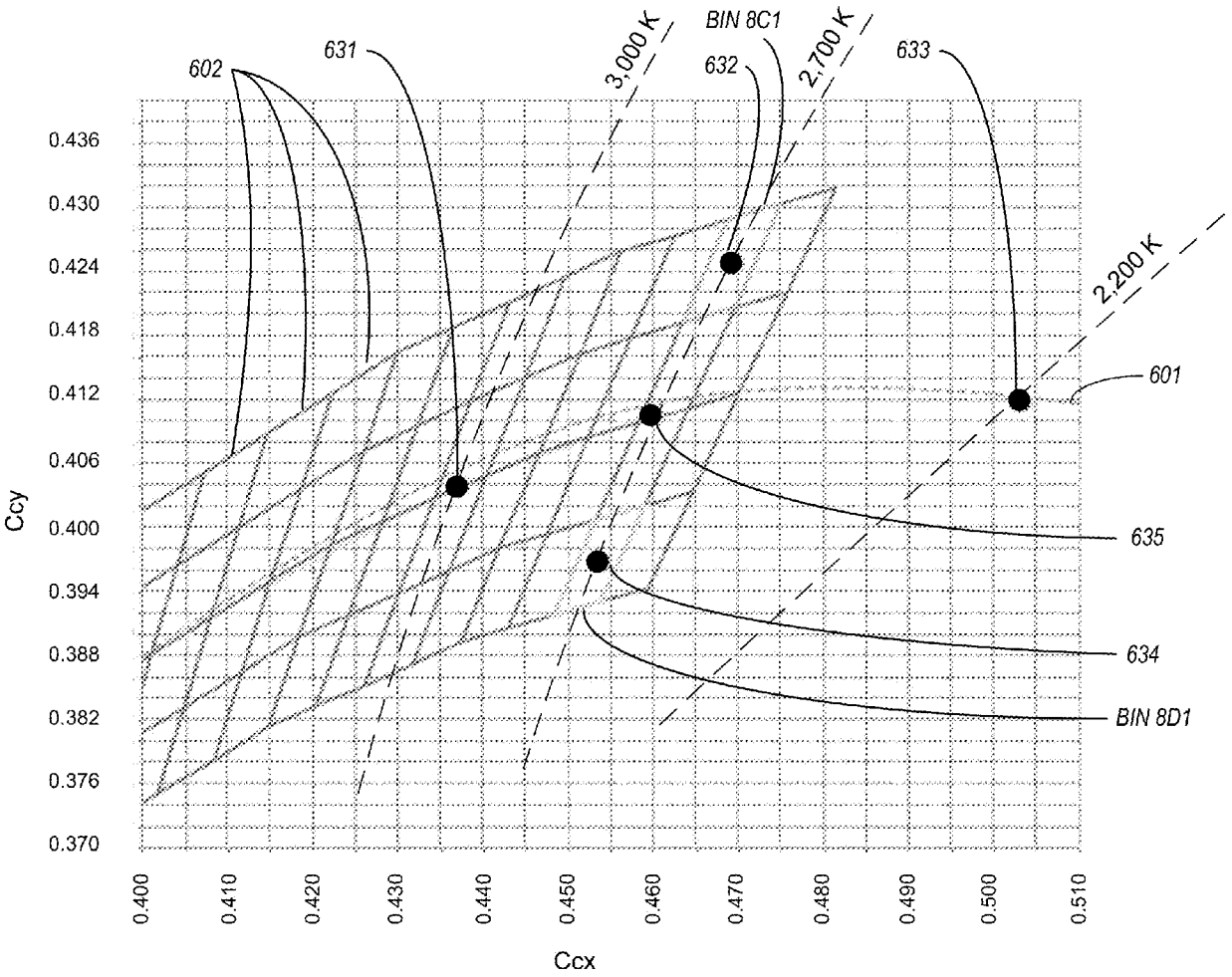
FIG. 6 depicts a chart of the color values for multiple sets of LEDs.

FIG. 6 depicts a chart of the color values for each of the five sets of LEDs (531, 532, 533, 534, 535) in Ccx-Ccy color space. Shown as a dotted line, the Planckian locus 601 represents a portion of the spectrum of black-body color temperatures in Ccx-Ccy space. Cells 602 correspond to a range of color values associated with a specified bin code.

As shown in FIG. 6, the first set of LEDs 531 corresponds to a black-body color temperature of approximately 3,000 degrees K, designated by point 631. The second set of LEDs 532 corresponds to a Ccx-Ccy color within a cell associated with bin 8C1 and designated by point 632. Although not directly on the Planckian locus 601, point 632 corresponds to a black-body color temperature of approximately 2,700 degrees K. The third set of LEDs 533 corresponds to a black-body color temperature of approximately 2,200 degrees K, designated by point 633. The fourth set of LEDs 534 corresponds to a Ccx-Ccy color within a cell associated with bin 8D1 and designated by point 634. While not directly on the Planckian locus 601, point 634 corresponds to a black-body color temperature of approximately 2,700 degrees K. The fifth set of LEDs 535 corresponds to a black-body color temperature of approximately 2,700 degrees K, designated by point 635.

Each of the five sets of LEDs (531, 532, 533, 534, 535) is connected to an output of a control circuit. In the present embodiment, the support structure 507 includes electrical traces connecting each set of LEDs in series to a pair of terminals on the support structure. Each pair of terminals is electrically connected to a controller circuit via a pair of conductive wires or other conductive element. Similar to the control circuit 150 discussed above with respect to FIG. 4, the control circuit of the present embodiment includes multiple power outputs that are independently adjustable from each other.

By adjusting the power to the five sets of LEDs (531, 532, 533, 534, 535), the luminous flux and color of the LED can be controlled. In general, by adjusting the total power provided to all of the sets of LEDs, the luminous flux or overall light output of the LED bulb can be controlled. By adjusting the relative power of the sets of LEDs with respect to each other, the color of the light output can be controlled. For example, by adjusting the relative power of the first set of LEDs 531 with respect to the third set of LEDs 533, the output color of the LED bulb can be shifted roughly along the direction of the Planckian locus 601. Similarly, by adjusting the relative power of the second set of LEDs 532 with respect to the fourth set of LEDs 534, the output color of the LED bulb can be shifted roughly perpendicular to direction of the Planckian locus 601.

FIG. 7 depicts Table 700 of relative power values for driving each of the five sets of LEDs (531, 532, 533, 534, 535) to produce a shifting color output that corresponds to a predetermined light-output curve. As shown in FIG. 7, Table 700 depicts parameters associated with six power states, each power state providing a different power configuration to the LEDs. The six power states depicted in Table 700 are exemplary and more than six power states may be used. In some cases, the power states may be representative of continuous power function.

In a typical implementation, the power states are provided by the control circuit of the LED bulb and may be stored in programmable memory and/or implemented as part of the electrical hardware configuration. The power states may be flash programmed during manufacture of the LED bulb or may be set using configurable electrical components of the control circuit.

The power levels depicted in Table 700 represent relative values and may vary depending particular LEDs used and on light output requirements of the LED bulb. For purposes of this analysis, ideal conditions are assumed. That is, the power is assumed to be delivered equally to each LED in a set and the power efficiency of each LED is assumed to be approximately equal. In a typical implementation, the power levels between power states may be interpolated to provide a smooth transition in light output when switching between power states. The transition typically corresponds to one or more predetermined light-output curve.

In this example, each power state is characterized by a different overall light output (luminous flux). The first row of Table 700 represents an exemplary full-power state and is characterized by a 100% luminous flux light output. The full-power state may correspond to the maximum predicted power output of the LED bulb. However, the full-power state is a relative measure and it is not necessary that the full-power state correspond to the maximum predicted power output of the LED bulb. The second through sixth rows of the Table 700 represent reduced-power states and are characterized by a light output that is less than 100%.

As shown in FIG. 7, each power state in this example is also characterized by a different predicted color output for the LED bulb. The predicted color output is described both with respect to a black-body color temperature in degrees K and with respect to Ccx-Ccy coordinates. The color values depicted in FIG. 7 represent the predicted composite color output for an LED bulb. Observed color values in an actual LED bulb may vary slightly depending on the observer's location with respect to the LEDs and the amount of light dispersion provided by LED bulb elements, such as the bulb shell.

In a typical implementation, the control circuit of the LED bulb is configured to switch between two or more power states. The control circuit is also configured to provide a transitional-power state between the two or more power states. The transitional-power state is configured to produce a shifting color output that corresponds to a predetermined light-output curve. In one example, the control circuit is configured to switch between an initial-power state (e.g., Table 700, row 2 at 2,584 K color temperature and 84% luminous flux) and a reduced-power state (e.g., Table 700, row 5 at 2,290 K color temperature and 23% luminous flux. In this example, the transitional-power state is configured to produce a shifting color output that corresponds to the intermediate power states (e.g., Table 100, rows 3 and 4) between the initial and reduced power state.

FIG. 8 depicts the predicted output colors associated with each of the power states, as plotted in Ccx-Ccy color space. As shown in FIG. 8, the predicted color output of the LED bulb corresponds to a predetermined light-output curve 801. The light-output curve 801 approximates the color shifting light output of an incandescent bulb as it is dimmed. The light-output curve 801 also approximates an ideal (Planckian) black-body emitter as it cools (or is dimmed). As depicted in FIG. 8, the light-output curve 801 is a non-linear curve in Ccx-Ccy space. In other words, the light-output curve 801 is not the inherent result of switching between two power states without providing a transitional-power state configured to produce a shifting color output.

As shown in FIG. 8 and Table 700, as the light output (luminous flux) is reduced, the black-body color temperature of the emitted light is also reduced. As previously mentioned, a reduction in black-body color temperature is also referred to as a "warmer" light output because of a perceived red-shift in the light color. Thus, in this example, the output of the LED bulb roughly corresponds to the emissions of a traditional incandescent bulb as it is dimmed.

The LED bulb described in this example can be configured to change power states in response to changes in AC power provided to the LED bulb. For example, a reduction in the AC power supplied to the LED bulb will result in a change in power state causing a reduction in the luminous flux and black-body color temperature of the emitted light. In some cases, the control circuit of the LED bulb can be configured for use with a traditional dimmer switch typically used for dimming incandescent lights.

In an alternative embodiment, and LED bulb may not include a thermally conductive liquid. Specifically, a thermally conductive liquid is not disposed between the LEDs and the shell of the bulb. Typically, the presence of absence of the thermally conductive liquid will change the color output of the LED bulb. In particular, an LED bulb without a thermally conductive liquid disposed between the LEDs and the shell will have a reduced level of blue color light in the emitted color spectrum. Thus, in this alternative embodiment, the black-body color temperature of the LEDs and/or the relative power levels of the LEDs will differ from the examples provided above.

Although a feature may appear to be described in connection with a particular embodiment, one skilled in the art would recognize that various features of the described embodiments may be combined. Moreover, aspects described in connection with an embodiment may stand alone.

What is claimed is:

1. A light-emitting diode (LED) bulb comprising:

a base;

a shell connected to the base;

a first set of LEDs disposed within the shell, wherein the first set of LEDs is configured to emit light at a first color;

a second set of LEDs disposed within the shell, wherein the second set of LEDs is configured to emit light at a second color that is different from the first color of the first set of LEDs; and a control circuit configured to provide:

an initial-power state to the first and second sets of LEDs to produce a first bulb light output having a first predicted luminous flux and a first predicted color, a reduced-power state to the first and second sets of LEDs to produce a second bulb light output having a second predicted luminous flux and a second predicted color, and a transitional-power state to the first and second sets of LEDs to transition between the initial-power state and the reduced-power state, wherein the transitional-power state is configured to produce a shifting color output that corresponds to a predetermined light-output curve having a first point corresponding to the first predicted color and a second point corresponding to the second predicted color.

2. The LED bulb of claim 1, wherein the predetermined light-output curve is a non-linear curve in Ccc-Ccy color space.

3. The LED bulb of claim 1, wherein the predetermined light-output curve approximates a predicted light output of an ideal Planckian black-body emitter.

4. The LED bulb of claim 1, wherein the first predicted luminous flux is greater than the second luminous flux, and wherein the first predicted color corresponds to a first predicted black-body color temperature that is greater than a second predicted black-body color temperature corresponding to the second predicted color.

5. The LED bulb of claim 1, wherein the first and second light outputs correspond to a predicted first and second light output of an incandescent light bulb.

6. The LED bulb of claim 1, wherein the control circuit is configured to provide the transitional-power state in response to a control signal.

7. The LED bulb of claim 1, wherein the control circuit is configured to provide the transitional-power state in response to a change in an input power provided to the LED bulb.

8. The LED bulb of claim 1, wherein the control circuit is further configured to provide a first power output to the first set of LEDs and a second power output to the second set of LEDs, wherein the second power output is independently adjustable with respect to the first power output to produce the shifting color output that corresponds to the predetermined light-output curve.

9. The LED bulb of claim 1, further comprising:

a third set of LEDs disposed within the shell, wherein the third set of LEDs is configured to emit light at a third color;

a fourth set of LEDs disposed within the shell, wherein the fourth set of LEDs is configured to emit light at a fourth color; and a fifth set of LEDs disposed within the shell, wherein the fifth set of LEDs is configured to emit light at a fifth color.

10. The LED bulb of claim 9, wherein the control circuit is further configured to provide a third power output to the third set of LEDs, a fourth power output to the fourth set of LEDs, and a fifth power output to the fifth set of LEDs, and wherein the second, third, fourth, and fifth power outputs are independently adjustable with respect to the first power output to produce the shifting color output that corresponds to the predetermined light-output curve.

11. The LED bulb of claim 9, wherein the first color corresponds to a first black-body color temperature of approximately 3,000 degrees K, the second color corresponds to a second black-body color temperature of approximately 2,700 degrees K, the third color corresponds to a third black-body color temperature of approximately 2,200 degrees K, the fourth color corresponds to a fourth black-body color temperature of approximately 2,700 degrees K, and the fifth color corresponds to a fifth black-body color temperature of approximately 2,700 degrees K.

12. A liquid-filled light-emitting diode (LED) bulb comprising:

a base;

a shell connected to the base;

a first set of LEDs disposed within the shell, wherein the first set of LEDs is configured to emit light at a first color;

a second set of LEDs disposed within the shell, wherein the second set of LEDs is configured to emit light at a second color that is different from the first color of the first set of LEDs;

a thermally conductive liquid held within the shell and disposed between the plurality of LEDs and the shell; and a control circuit configured to provide:

an initial-power state to the first and second sets of LEDs to produce a first light output having a first predicted luminous flux and a first predicted color, a reduced-power state to the first and second sets of LEDs to produce a second light output having a second predicted luminous flux and a second predicted color, and a transitional-power state to the first and second sets of LEDs to transition between the initial-power state and the reduced-power state, wherein the transitional-power state is configured to produce a shifting color output that corresponds to a predetermined light-output curve having a first point corresponding to the first predicted color and a second point corresponding to the second predicted color.

13. The liquid-filled LED bulb of claim 12, wherein the predetermined light-output curve is a non-linear curve in Ccc-Ccy color space.

14. The liquid-filled LED bulb of claim 12, wherein the predetermined light-output curve approximates a predicted light output of an ideal Planckian black-body emitter.

15. The liquid-filled LED bulb of claim 12, wherein the first predicted luminous flux is greater than the second luminous flux, and wherein the first predicted color corresponds to a first predicted black-body color temperature that is greater than a second predicted black-body color temperature corresponding to the second predicted color.

16. A liquid-filled light-emitting diode (LED) bulb comprising:

a base;

a shell connected to the base;

a first set of LEDs disposed within the shell, wherein the first set of LEDs is configured to emit light at a first color;

a second set of LEDs disposed within the shell, wherein the second set of LEDs is configured to emit light at a second color that is different from the first color;

a thermally conductive liquid held within the shell and disposed between the first and second set of LEDs and the shell; and a control circuit configured to provide a first power output to the first set of LEDs and a second power output to the second set of LEDs, wherein the second power output is independently adjustable with respect to the first power output to produce a bulb light output having a shifting color that corresponds to a predetermined light-output curve.

17. The liquid-filled LED bulb of claim 16, wherein the control circuit is further configured to:

provide a full-power state to the first and second set of LEDs, the full-power state being associated with an initial first power level for the first set of LEDs, an initial second power level for the second set of LEDs, a first predicted luminous flux, and a first predicted color output;

provide a reduced-power state to the first and second set of LEDs, the reduced-power state being associated with a reduced first power level for the first set of LEDs, a reduced second power level for the second set of LEDs, a second predicted luminous flux, and a second predicted color output; and provide a transitional-power state to the first and second set of LEDs, to transition between the initial-power state and the reduced-power state, wherein the transitional-power state is configured to produce the shifting color that corresponds to the predetermined light-output curve.

18. A method of making a light-emitting diode (LED) bulb, the method comprising:

obtaining a base, a shell, a first set of LEDs, and a second set of LEDs;

attaching the first and second set of LEDs to the base;

connecting the shell to the base, wherein the first and second sets of LEDs are disposed within the shell;

electrically connecting the first set of LEDs to a first power output of a control circuit;

electrically connecting the second set of LEDs to a second power output of the control circuit, wherein the first power output is independently adjustable with respect to the second power output to produce a bulb light output having a shifting color that corresponds to a predetermined light-output curve; and filling the shell with a thermally conductive liquid, wherein the first and second set of LEDs are immersed in the thermally conductive liquid.

* * * * *